US008202203B2

(12) United States Patent
Lim

(10) Patent No.: US 8,202,203 B2
(45) Date of Patent: Jun. 19, 2012

(54) PORTABLE ACROBATIC TRAINER APPARATUS

(75) Inventor: Jung M. Lim, Lansdale, PA (US)

(73) Assignee: Norbert's Athletic Products, Wilmington, CA (US)

( * ) Notice: Subject to any disclaimer, the term of this patent is extended or adjusted under 35 U.S.C. 154(b) by 0 days.

(21) Appl. No.: 12/870,198

(22) Filed: Aug. 27, 2010

(65) Prior Publication Data

US 2010/0323847 A1 Dec. 23, 2010

Related U.S. Application Data

(62) Division of application No. 12/321,468, filed on Jan. 21, 2009, now Pat. No. 7,789,805.

(51) Int. Cl.
*A63B 21/00* (2006.01)

(52) U.S. Cl. ..... 482/35; 482/130; 482/140; 297/423.41; 297/452.4; 5/652; 5/630; 5/632; 5/655.3

(58) Field of Classification Search ..... 482/35, 482/130, 140; 297/423.41, 452.4; 5/652, 5/630, 632, 655.3
See application file for complete search history.

(56) References Cited

U.S. PATENT DOCUMENTS

| | | | |
|---|---|---|---|
| 2,107,377 | A | 2/1938 | Howland |
| 2,521,530 | A | 9/1950 | McGuffage |
| 2,822,554 | A | 2/1958 | Wenzelberger |
| 3,628,790 | A | 12/1971 | Gordon |
| 4,969,222 | A | 11/1990 | Serola |
| 6,575,885 | B1 | 6/2003 | Weck et al. |
| D523,494 | S | 6/2006 | Van Straaten |
| 2008/0096740 | A1 | 4/2008 | Nichols |

OTHER PUBLICATIONS

Gibson, 2009 Equipment Catalog, 2009 p. 42, Gibson Corporation, Englewood, CO USA.
Norbert's Athletic Products, Catalog 36, Jun. 2008, pp. 6 and 36, San Pedro, CA USA.
Core Athletics, www.coreathletics.com, 2009, Core Athletics, Newburyport, MA USA.

*Primary Examiner* — Jerome w Donnelly
(74) *Attorney, Agent, or Firm* — Davis & Bujold, P.L.L.C.

(57) ABSTRACT

One embodiment of a portable acrobatic training apparatus (I) with which to support and instruct athletes learning back handsprings having opposing flat vertical ends (16), a resilient arcuate uppermost surface (10), a flat horizontal base (12), and a convex near surface (14). Said trainer apparatus is of approximate elliptical shape, rests on its base until intentionally activated by user, is self-limiting rotationally, and returns to start position automatically following each usage.

20 Claims, 3 Drawing Sheets

PORTABLE ACROBATIC TRAINER APPARATUS

CROSS-REFERENCE TO RELATED APPLICATIONS

Not Applicable.

FEDERALLY SPONSORED RESEARCH

Not Applicable

SEQUENCE LISTING OR PROGRAM

Not Applicable

BACKGROUND

1. Field

This application relates to acrobatic training devices, specifically those devices used to teach or learn back handspring skills.

2. Prior Art

Back handspring is an acrobatic progression in which athletes, starting from standing position, leap backwards into the air, execute a full back-to-front revolution and land on both hands in a handstand position from which they spring back up. returning to standing position. Back handspring is one of several essential skills basic to tumbling, gymnastics, acrodancing, cheerleading, and similar activities.

Training athletes to perform back handsprings presents coaches with several interrelated challenges, including:

(a) Teaching essential body mechanics, proper positioning, and correct form to perform this progression, and (b) Promoting development of students' kinesthetic sense, and (c) Assisting students to alleviate and overcome reflexive, instinctive fear of leaping backward blindly into space, and (d) Providing physical support to students as they practice this progression.

All above may be addressed at basic level by an array of techniques collectively and commonly known as spotting whereby a coach verbally directs and manually guides students' movements throughout each element of a routine. Spotters also catch or otherwise physically intervene as necessary to prevent athletes from injuring themselves.

Spotting a person engaged in rapid aerial motion, especially on a frequent, repetitive basis is arduous labor that places coaches in considerable jeopardy of sustaining chronic, occasionally severe, orthopedic damage.

Manual spotting supplemented by specialized equipment potentially resolves these issues to the extent available equipment satisfies unique needs of coaches as well as athletes in this endeavor.

All such devices heretofore known suffer from one or more disadvantages:

(a) Belts in conjunction with various aerial suspension systems as disclosed in U.S. Pat. No. 2,107,377 to Howland (1938) support body weight and, when properly used, may protect athletes from catastrophic crash landings. Usage is restricted to specific fixed areas by fact of attachment to stationary mounted frames, ceiling beams, tracks or apparatus such as trampoline frames. In addition to which, belts attach around the waist thereby depriving users of full back support.

(b) Multi-faceted regular polygonal spheres as proposed in U.S. Pat. No. 3,628,790 by Gordon (1971) are embodied most frequently as octagons. When properly sized to accommodate individual users, these forms reduce weight load otherwise borne by spotters and provide users with a degree of support throughout the stretched flight stage. Regular polygonal spheres do not enable users to adequately emulate required positions thus causing students to bend their knees incorrectly, overarch, or both. All spheres, whether polygonal or rounded, are prone to uncontrolled rotation and instability when acted upon by users.

(c) Devices commonly designated as "Handspring Machines" or "Pac-Man Handspring Trainers" are available from a number of suppliers. These are modified spheres being generally round, but representing only 270° of a full circle. This design requires users to lunge backwards from a seated position rather than from the preferred upright standing position. They do not provide inadequate back support throughout the stretched flight stage and are prone to uncontrolled rotation. When using this type of apparatus, users frequently tend to break form by bending their knees incorrectly.

(d) Various combinations of incline and flat standard landing mats, also disclosed in U.S. Pat. No. 3,628,790 by Gordon (1971), none of which are expressly intended solely for this purpose and are, therefore, inadequate to fulfill unique needs of coaches and their students, (e) A padded bar mounted horizontally at approximately waist height between uprights has been recently observed and offered in the market. This solution does not provide sufficient support full range of motion.

Because of these and other disadvantages of known prior art, there exists a need for a portable acrobatic training apparatus to adequately support and properly position athletes while acquiring skills necessary to perform back handsprings. Such apparatus should remain stationary until deliberately set in motion by user action, provide smooth transport within a limited range of transitional rotation, and be capable of returning automatically to start position.

SUMMARY

In accordance, one embodiment of a portable acrobatic trainer as a supplemental device for coaching back handsprings comprises an approximate ellipse having two vertical ends, a resilient arcuate upper surface contiguously joined with flat horizontal base. The proposed apparatus remains stationary until set in motion by momentum of an athlete leaping onto it. Upon activation, device begins clockwise translational rotation fully supporting and transporting athlete throughout stretched arch phase of this skill. At a predetermined point, rotation ceases, projecting athlete forward into correct handstand position. Trainer automatically counter rotates and returns to starting position, ready for immediate use.

DRAWINGS

Figures

In the drawings, closely related figures are referred to by the same number, but different alphabetic suffixes.

DRAWINGS

Reference Numbers

| | |
|---|---|
| 10. Uppermost surface | 12. Horizontal Base |
| 14. Rear surface | 16. Vertical End |
| 18. Core | 20. Coated Vinyl Fabric Cover |
| 22. Directional Line (H) | 24. Directional Line (W) |
| 26. Directional Line (L) | H. Athlete |
| I. Trainer Apparatus | P. Directional Path |

DRAWINGS

Detailed Description of First Embodiment

Figure 1A:
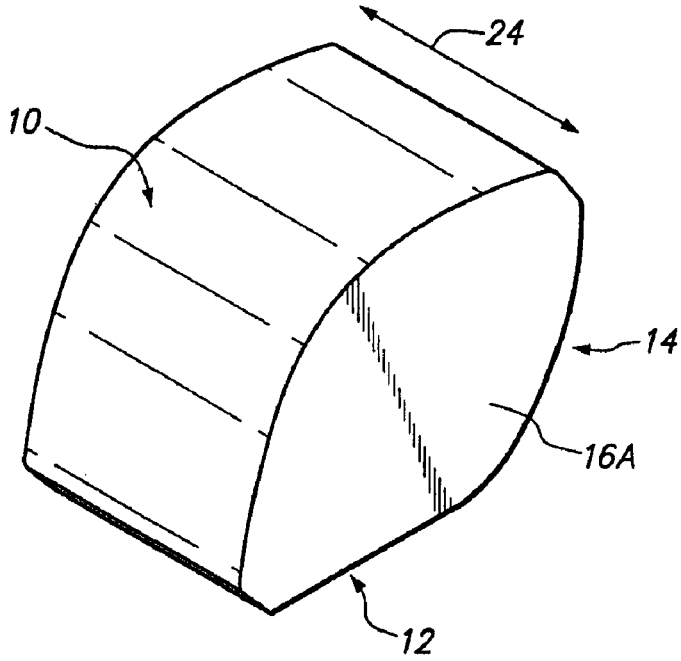
FIGS. 1A and 1B show opposing perspective views of the proposed trainer apparatus.
Figure 1B:
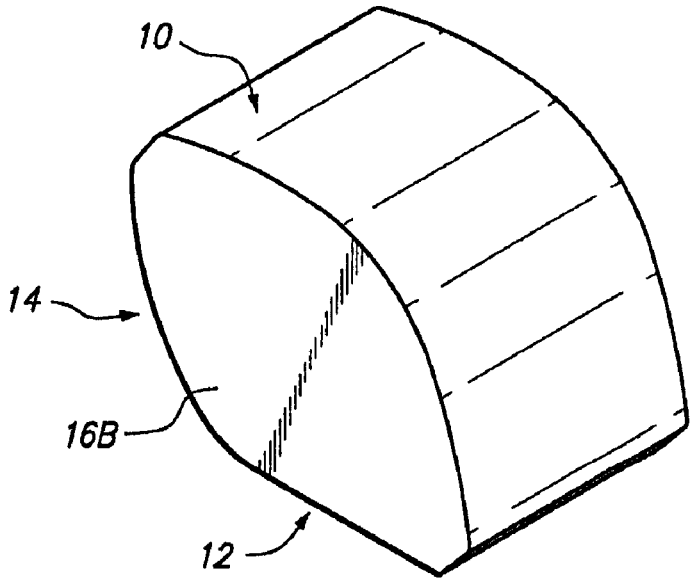
Figure 3:
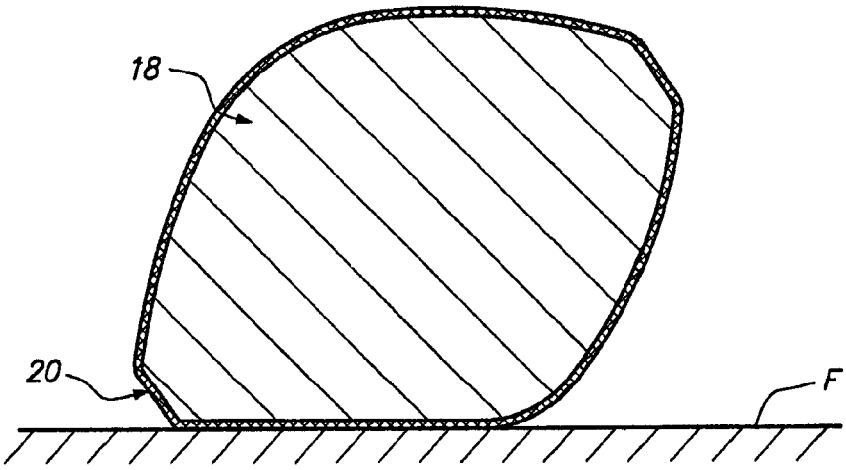
FIG. 3 is a cross-sectional end view of trainer
Figure 4A:
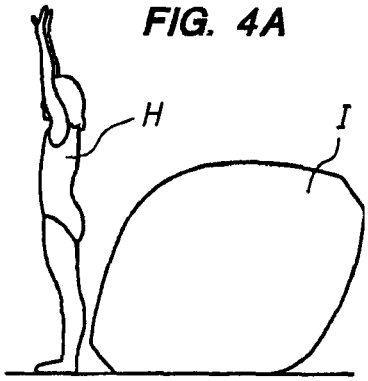
FIGS. 4A through 4G show elevational end views of trainer apparatus in use illustrating operational progression from start to finish.
Figure 4B:
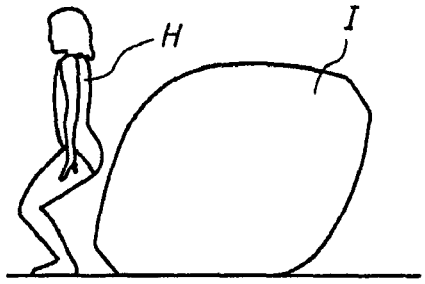
Figure 4C:
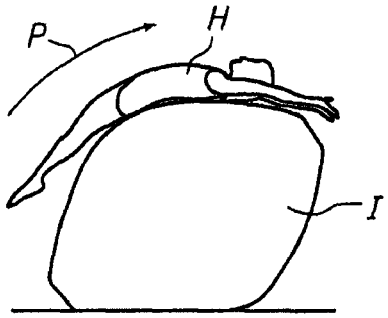
Figure 4D:
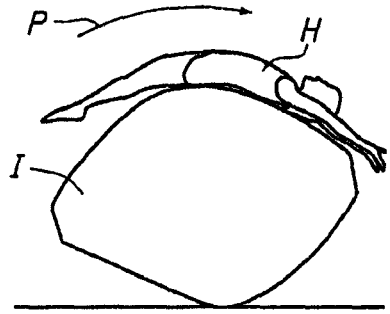
Figure 4E:
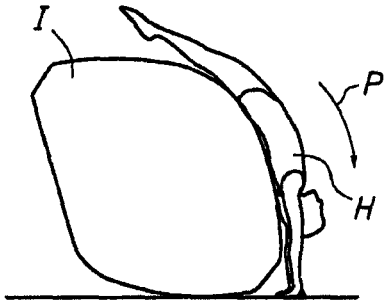
Figure 4F:
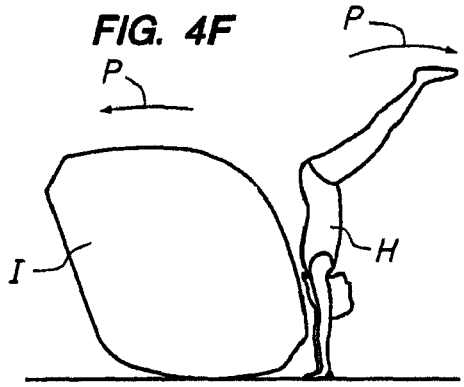
Figure 4G:
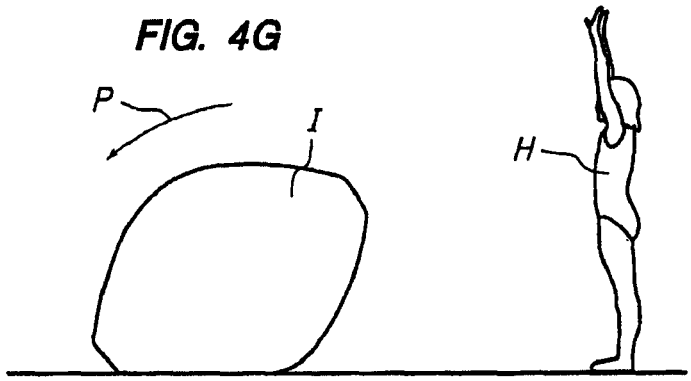

Referring now to the drawings in detail, one embodiment of the training apparatus revealed herein is illustrated in FIGS. 1A and 1B. The trainer apparatus comprises a core 18 (FIG. 3) of resilient plastic foam material, e.g. polyurethane foam, and a cover 20 of plastic coated fabric. The apparatus is of a shape approximating an ellipse, having two opposing flat vertical ends 16*a* and 16*b*, a flat horizontal base 12, an arcuate uppermost surface 10, and a convex rear surface 14. Base 12 joins uppermost surface 10, which, in turn, joins rear surface 14 such that all three surfaces are joined contiguously.

In viewing the illustrated embodiment, the reader will understand the desirability of having trainer apparatus severally rendered in dimensions proportionate to body height of various potential users. In my experience, this can best be accomplished with at least three scaled renditions, the smallest of which having a minimum width W (along line 24, FIG. 1A) of 26", a minimum length L (along line 26, FIG. 2) of 42", and minimum height H (along line 24, FIG. 2), of 32" to ensure stability and provide users with sufficient support.

Figure 2:
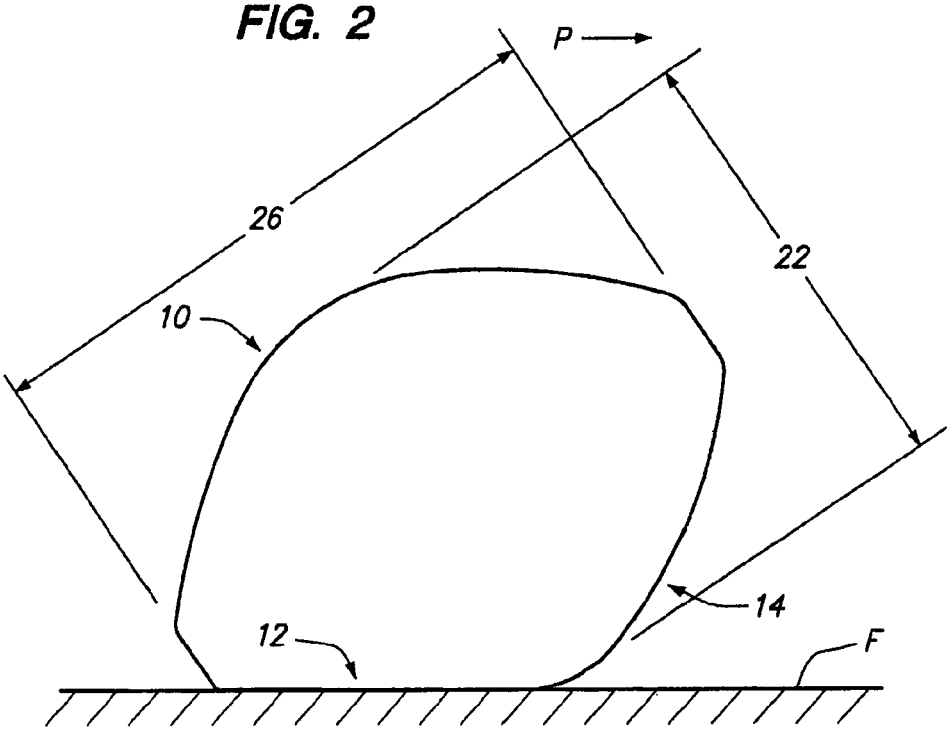
FIG. 2 shows an elevational end view of trainer apparatus.

FIG. 2 additionally illustrates front to rear orientation and also defines the directional path P of movement upon activation.

FIGS. 4A-4G illustrate approximately the progression of movements performed by athlete H to operate the trainer apparatus I. These are as follows:

(a) (FIG. 4A) athlete H stands upright, facing opposite trainer apparatus I with arms fully extended directly above the head.

(b) (FIG. 4B) athlete H drops arms to sides, keeps torso vertical while simultaneously dropping into a static upright squat position, knees bent at an angle of approximately 110°-120°, (c) (FIG. 4C) athlete A throws arms up and behind the body and lunges upwards and backwards in a stretched arch position onto trainer apparatus I.

(d) (FIG. 4D) force generates momentum thus activating trainer apparatus I, which, in turn, transports athlete A forward through flight, stage along directional path P.

(e) (FIG. 4E) trainer apparatus approaches farthest point of rotation as athlete A contacts floor with hands.

(f) (FIG. 4F) trainer apparatus I arrives at farthest point of rotation, stops, and begins counter-rotation causing athlete A to snap forward into handspring position.

(g) (FIG. 4G) trainer apparatus I counter rotates and returns to original point of equilibrium at starting position; athlete A completes handspring in upright standing position.

CONCLUSION, RAMIFICATIONS, AND SCOPE

Accordingly, the reader will see the benefits of the embodied portable acrobatic trainer apparatus in providing a supportive platform for coaching athletes wishing to learn back handspring skills. Furthermore, the trainer apparatus has additional advantages in that:

It emulates proper body positioning throughout the progression of movements specific to back handsprings.

It is portable and can be utilized without additional hardware or supports.

It remains immobile until deliberately activated.

Rotation is self-limiting.

Although the description above contains specificities, these should not be considered as limiting the scope of the embodiments, but merely as illustrating some presently preferred embodiments.

Thus, the scope of the embodiments should be determined solely by the appended claims and their legal equivalents, rather than examples provided herein.

I claim:

1. A portable training apparatus comprising:

a base surface, a stop surface and a rounded surface;

an upper arcuate surface, located opposite the base surface, the stop surface and the rounded surface, for engaging with a lower leg region, an upper leg region, a pelvic region, and a lower thorax region of an athlete when performing a backflip exercise while using the training apparatus;

wherein the stop surface is located adjacent the base surface, and the rounded surface interconnects the stop surface with the base surface;

the base surface provides a stable first position for supporting the training apparatus on a support surface while the stop surface provides an unstable second position which stops further rotation of the training apparatus; and when performing the exercise, the training apparatus is normally supported on the support surface by the base surface and as the athlete lunges onto the upper arcuate surface of the training apparatus, while performing the exercise, the athlete causes the training apparatus to roll from the base surface to the stop surface, and, following completion of the exercise by the athlete, a weight distribution of the training apparatus automatically causes the training apparatus to roll back from the unstable second position, in which the stop surface engages with the support surface, along the rounded surface and onto the base surface so that the training apparatus is again supported in the stable first position by the base surface.

2. The training apparatus according to claim 1, wherein the base surface is a substantially flat surface.

3. The training apparatus according to claim 1, wherein the training apparatus is elliptical in shape.

4. The training apparatus according to claim 1, wherein opposed ends of the training apparatus each have a flat surface.

5. The training apparatus according to claim 1, wherein a core of the training apparatus is solid.

6. The training apparatus according to claim 1, wherein the training apparatus is inflatable and the base surface is weighted so as to automatically cause the training apparatus to roll back from the unstable second position into the stable first position.

7. The training apparatus according to claim 1, wherein, when the training apparatus is supported by the base surface on the support surface, a majority of the weight of the training apparatus is distributed vertically above the base surface so that the weight distribution assists with forming the stable first position for the training apparatus and automatic rolling of the training apparatus back from the stop surface along the rounded surface onto the base surface so that the training apparatus is again supported in the stable first position by the base surface.

8. The training apparatus according to claim 1, wherein the training apparatus has a solid core and has an exterior cover.

9. The training apparatus according to claim 8, wherein the core is made of resilient plastic and the cover is a plastic fabric.

10. The training apparatus according to claim 1, wherein the upper arcuate surface is sized to support a body of the athlete while the athlete preforms performs the exercise using the training apparatus.

11. The training apparatus according to claim 10, wherein the training apparatus has a width of at least 26 inches and a height of at least 22 inches.

12. The training apparatus according to claim 1, wherein, when the training apparatus is supported by the base surface in the stable first position, the stop surface is cantilevered above the support surface while a majority of the weight of the training apparatus is located vertically above the base surface so that the weight distribution assists with forming the stable first position for the training apparatus as well as provides a force for returning the training apparatus back to the stable first position.

13. The training apparatus according to claim 1, wherein the rounded surface, which interconnects the stop surface with the base surface, has a smaller radius of curvature than a radius of curvature of the upper arcuate surface.

14. A portable training apparatus comprising:

a flat base surface;

a stop surface is located adjacent the base surface;

an upperarcuate surface, located opposite the base surface and the stop surface, for engaging with a body lower leg region, an upper leg region, a pelvic region, and a lower thorax region of an athlete when practicing a back flip exercise while using the training apparatus;

wherein a rounded surface interconnects the stop surface with the base surface;

the base surface provides a stable first position for supporting the training apparatus on a support surface so that the athlete may stand adjacent the training apparatus with the training apparatus in the stable first position, and a weight distribution of the training apparatus is distributed so that the training apparatus normally rests on the base surface in the stable first position, a contour of the base surface, the stop surface and the rounded surface facilitates rolling of the training apparatus from the base surface onto the stop surface, as the athlete performs the flip exercise using the training apparatus, and due to the weight distribution of the training apparatus, and the stop surface forms an unstable second position which, following completion of the exercise by the athlete, the training apparatus automatically rolls back from the unstable second position to the stable first position, due to the weight distribution, so that the training apparatus is again supported by the base surface.

15. The training apparatus according to claim 14, wherein the rounded surface, which interconnects the stop surface with the base surface, has a smaller radius of curvature than a radius of curvature of the upper arcuate surface and the training apparatus is oval in shape.

16. A method of an athlete using a portable training apparatus to perform a flip exercise, the training apparatus comprising a base surface; an upper arcuate surface, located opposite the base surface, for engaging with the athlete while performing the flip exercise when using the training apparatus; wherein a stop surface is located adjacent the base surface, and a rounded surface interconnects the convex stop surface with the base surface; the base surface provides a stable first position for supporting the training apparatus on a support surface, and a weight distribution of the training apparatus is distributed so as to facilitate rolling movement for the training apparatus from the base surface onto the stop surface, as the athlete performs the exercise while using the training apparatus, and, following completion of the flip exercise by the athlete, the training apparatus automatically rolls back, due to the weight distribution, to the stable first position so that the training apparatus is again supported on the base surface, the method comprising the steps of:

a) having the athlete stand adjacent the training apparatus;

b) having the athlete lunge onto the upper arcuate surface of the training apparatus while performing the flip exercise;

c) the athlete causing the training apparatus to roll from the base surface onto the stop surface during the flip exercise; and d) following completion of the flip exercise by the athlete, the weight distribution of the training apparatus automatically rolling the training apparatus back from an unstable second position of the stop surface to the stable first position in which the training apparatus is again supported on the base surface.

17. The training apparatus according to claim 1, wherein opposed ends of the training apparatus both taper to a smallest dimension of the training apparatus.

18. The training apparatus according to claim 1, wherein the base surface rolls out of engagement with the support surface when the training apparatus rolls from the base surface onto the stop surface.

19. The training apparatus according to claim 14, wherein the base surface rolls out of engagement with the support surface when the training apparatus rolls from the base surface onto the stop surface.

20. The training apparatus according to claim 14, wherein opposed ends of the training apparatus both taper to a smallest dimension of the training apparatus.

* * * * *